US009494118B2

(12) United States Patent
Badarinarayan et al.

(10) Patent No.: US 9,494,118 B2
(45) Date of Patent: Nov. 15, 2016

(54) FUEL DELIVERY SYSTEM FOR AN INTERNAL COMBUSTION ENGINE

(71) Applicant: Hitachi Automotive Systems Americas Inc., Harrodsburg, KY (US)

(72) Inventors: Harsha Badarinarayan, Canton, MI (US); Donald J. McCune, Farmington Hills, MI (US)

(73) Assignee: Hitachi Automotive Systems Americas Inc., Harrodsburg, KY (US)

( * ) Notice: Subject to any disclaimer, the term of this patent is extended or adjusted under 35 U.S.C. 154(b) by 224 days.

(21) Appl. No.: 14/284,716

(22) Filed: May 22, 2014

(65) Prior Publication Data

US 2015/0316015 A1 Nov. 5, 2015

Related U.S. Application Data

(63) Continuation-in-part of application No. 14/265,925, filed on Apr. 30, 2014.

(51) Int. Cl.

| | |
|---|---|
| ***F02M 69/46*** | (2006.01) |
| ***F02M 55/02*** | (2006.01) |
| ***F02M 63/02*** | (2006.01) |
| ***F02M 63/00*** | (2006.01) |
| ***F02M 55/04*** | (2006.01) |

(52) U.S. Cl.

CPC ..... *F02M 55/025* (2013.01); *F02M 55/04* (2013.01); *F02M 63/0054* (2013.01); *F02M 63/023* (2013.01); *F02M 63/0275* (2013.01)

(58) Field of Classification Search

CPC ..... F02M 63/0225; F02M 61/08; F02M 55/025; F02M 63/0275

See application file for complete search history.

(56) References Cited

U.S. PATENT DOCUMENTS

| | | | | |
|---|---|---|---|---|
| 2,037,499 | A * | 4/1936 | Collard | B60K 15/0406 220/303 |
| 3,491,790 | A * | 1/1970 | Sanford | F16K 15/04 137/533.11 |
| 4,095,609 | A * | 6/1978 | Martin | B60K 15/03519 137/43 |
| 4,996,962 | A * | 3/1991 | Usui | F02M 69/465 123/456 |
| 5,070,844 | A * | 12/1991 | Daly | F02M 51/005 123/456 |
| 5,593,292 | A * | 1/1997 | Ivey | F04B 53/1007 137/533.15 |
| 8,091,583 | B2 | 1/2012 | Olshanetsky et al. | |
| 8,113,796 | B2 | 2/2012 | Marx et al. | |
| 8,245,693 | B2 | 8/2012 | Surnilla et al. | |
| 8,342,158 | B2 | 1/2013 | Ulrey et al. | |
| 2004/0117010 | A1* | 6/2004 | Houston | A61F 2/2406 623/2.33 |

FOREIGN PATENT DOCUMENTS

| | | | |
|---|---|---|---|
| DE | EP 1048843 A2 * | 11/2000 | F02M 63/0007 |
| JP | 2010265907 A * | 11/2010 | |
| JP | 2010281330 A * | 12/2010 | |

OTHER PUBLICATIONS

JP 2010265907 Translation.*

* cited by examiner

*Primary Examiner* — Marguerite McMahon
*Assistant Examiner* — Tea Holbrook
(74) *Attorney, Agent, or Firm* — Dinsmore & Shohl LLP; Douglas W. Sprinkle

(57) ABSTRACT

A fuel delivery system for an internal combustion engine having a fuel pump with a high pressure outlet. A fuel rail defining an internal fuel chamber is fluidly connected to the fuel pump outlet. Additionally, at least two fuel injectors are fluidly connected to the fuel rail internal fuel chamber. At least one fluid check valve is fluidly positioned within the fuel rail in between two of the fuel injectors which reduces fuel pressure pulsations.

15 Claims, 3 Drawing Sheets

FUEL DELIVERY SYSTEM FOR AN INTERNAL COMBUSTION ENGINE

CROSS-REFERENCE TO RELATED APPLICATIONS

This application is a continuation-in-part of U.S. patent application Ser. No. 14/265,925 filed Apr. 30, 2014, the contents of which are incorporated herein by reference.

BACKGROUND OF THE INVENTION

I. Field of the Invention

The present invention relates to a fuel delivery system and, more particularly, to a fuel delivery system for an internal combustion engine having fuel injectors.

II. Description of Related Art

Modern day internal combustion engines of the type used in automotive vehicles typically use fuel injectors in order to inject the fuel into the fuel combustion chamber. Many modern day internal combustion engines, furthermore, are direct injection engines in which the fuel injectors are open directly to the internal combustion chamber.

In order to overcome the high pressures present within the internal combustion chamber of a direct injection engine, the fuel must be delivered to the fuel injectors at a high fuel pressure. Conventionally, a high pressure pump provides fuel to a fuel rail which extends along the fuel injectors. Each injector is then fluidly connected to an internal fuel chamber of the fuel rail by a fuel port.

In order to achieve the high pressures necessary for the fuel injection of a direct injection engine, many previously known fuel pumps utilize a reciprocating piston within the pump chamber to not only induct fuel from the fuel source or gas tank into the pump chamber, but to also pump the fuel from the pump chamber out to the fuel rail. Typically, these pistons on these previously known fuel pumps utilize a cam lobe which is rotatably driven in synchronism with the engine such that the outer cam surface mechanically and reciprocally displaces the pump piston to pump the fuel.

While these previously known direct injection internal combustion engines enjoy high efficiency, fuel economy, and other advantages, one disadvantage of the direct injection engines is that pressure pulsations within the fuel delivery system create both vibration and noise from the engine. This noise is particularly audible at low engine speeds, such as idle.

SUMMARY OF THE INVENTION

The present invention provides a fuel delivery system which overcomes the above mentioned disadvantages of the previously known fuel delivery systems.

In brief, the fuel delivery system of the present invention includes a fuel pump having a high pressure outlet. A fuel rail defines an internal fuel chamber and is fluidly connected to the fuel pump outlet. As such, fuel delivered by the fuel pump pressurizes the internal fuel chamber within the fuel rail.

At least two fuel injectors are fluidly connected to the internal fuel chamber of the fuel rail through a fuel port so that one fuel port is associated with each fuel injector. Consequently, during the operation of the engine, fuel is pumped from the fuel pump, through the fuel rail, and out through the fuel port to the fuel injectors.

In order to minimize the back and forth travel of pressure waves within the fuel system, and particularly within the fuel rail, at least one check valve is fluidly positioned in the internal fuel chamber of the fuel rail immediately downstream from each fuel injector port. The check valve thus permits the fuel flow from the fuel pump through the fuel rail and to the fuel injector ports, but prevents the reverse flow of fuel caused by a pressure wave in the reverse direction through the fuel rail and toward the pump. In doing so, pressure pulsations and the resultant noise and vibration are greatly reduced if not altogether eliminated. As a still further advantage, the check valves reduce variations in the fuel pressure throughout the entire length of the fuel rail so that the fuel pressure at the fuel port for each fuel injector is substantially equal at all times.

Although different types of check valves may be used, the check valve includes a circular plate which forms the valve seat and has its outer periphery sealingly attached to the inner periphery of the fuel rail. A circular port is formed in the center of the valve seat which establishes fluid flow through the valve seat.

A ball and retainer cage is also associated with each check valve such that the cage retains the ball to the seat. Furthermore, the ball is movable between a closed position in which the ball contacts the valve seat and prevents fluid flow through the valve seat, and an open position in which the ball is spaced from the port in the valve seat and allows fluid flow through the port.

One check valve is provided immediately downstream from each of the fuel injector ports and oriented so that the check valves only allow fuel to flow in the direction from the fuel pump and toward the end of the fuel rail. Conversely, fuel flow from the distal end of the fuel rail back towards the fuel pump is prevented by the closure of the ball check valves. The operation of the ball check valves thus effectively prevents, or at least greatly minimizes, the back and forth travel of pressure wave valves throughout the fuel rail.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2, 3:
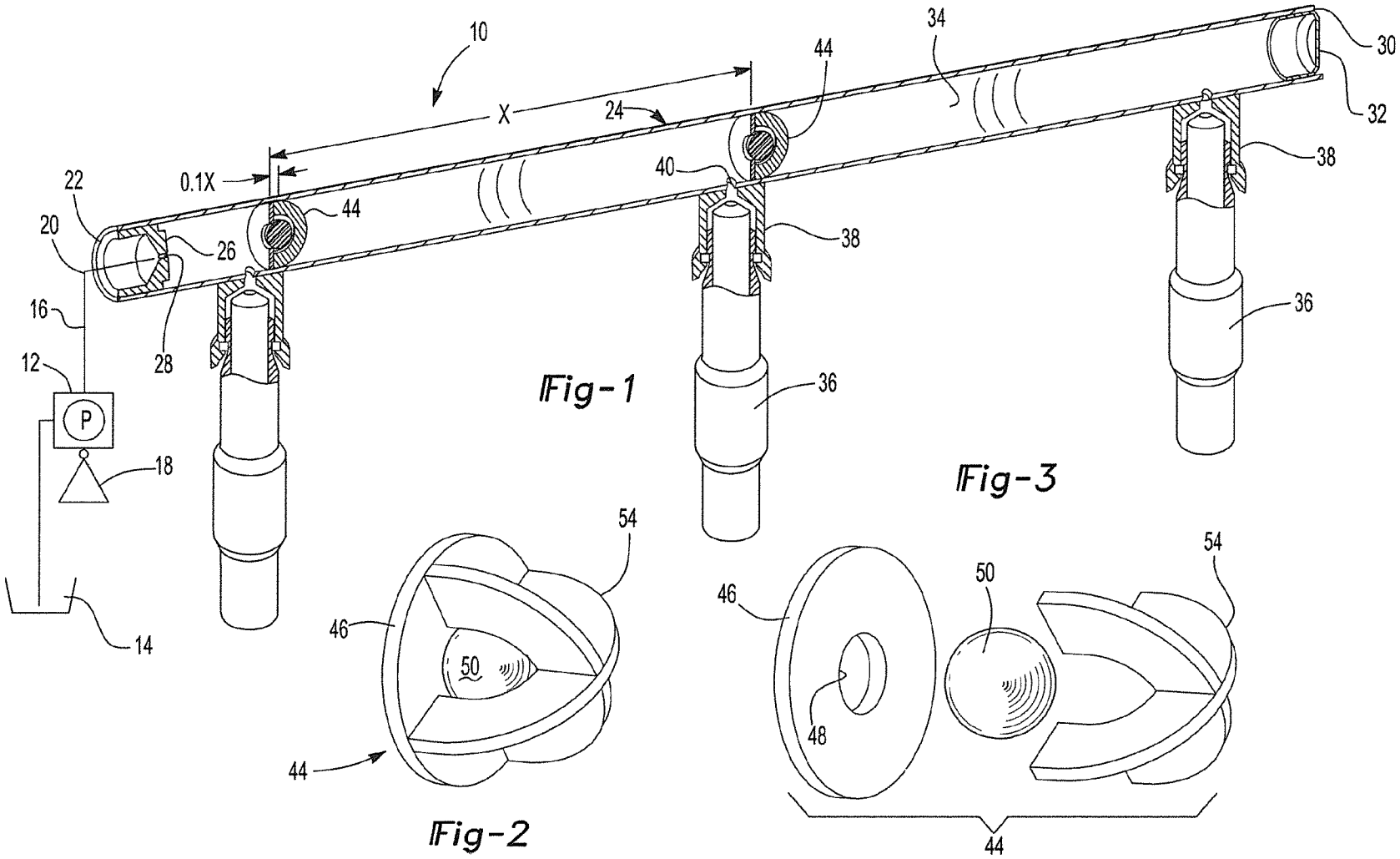
FIG. 1 is a longitudinal sectional and partially diagrammatic view illustrating an embodiment of the fuel delivery system.
FIG. 2 is an elevational view illustrating a check valve.
FIG. 3 is an exploded view of the check valve.

With reference first to FIG. 1, an embodiment of a fuel delivery system 10 is shown. The fuel delivery system 10 includes a high pressure fuel pump 12 which inducts fuel from a fuel source 14, e.g. a fuel tank, and provides pressurized fuel at a fuel pump outlet 16.

While the fuel pump 12 may be of any construction, the fuel pump 12 may be a piston pump in which a piston is reciprocally driven within a pump chamber. A cam 18 reciprocally drives the piston within the pump chamber to provide fuel pump pulsations through an outlet valve at the pump outlet 16. It is these fuel pulsations which form one source of fuel pulsations within the fuel system 10.

The pressure pulsations within the fuel delivery system originate from two different sources. First, the rapid and continuous opening and closing of the high pressure pump outlet valve creates high pressure pulsations within the fuel rail during each pump cycle of the pump piston. These pressure pulsations resonate between the ends of the fuel rail thus causing both the vibration and noise.

Secondly, the repeated opening of the fuel injectors in synchronism with the engine operation again also causes pressure pulsations within the fuel rail. These pressure pulsations create pressure waves which travel back and forth throughout the fuel system creating both audible noise as well as vibration within the system. This vibration in certain cases can also result in part fatigue and damage to the engine.

A still further disadvantage of the back and forth travel of the pressure wave within the fuel system is that the pressure wave results in pressure variations throughout the fuel rail. These pressure variations, in turn, vary the instantaneous pressure of the fuel provided to the multiple fuel injectors fluidly connected to the fuel rail. Consequently, the actual volume of fuel provided by each fuel injector upon opening varies as a function of the fuel pressure at the fluid port to the fuel injector at the time of opening. The varying amounts of fuel provided by the fuel rail to the fuel injectors in return create engine inefficiencies and adversely affect fuel economy and engine performance.

Still referring to FIG. 1, the pump outlet 16 is fluidly connected by a fluid line 20 to an inlet end 22 of an elongated tubular and cylindrical fuel rail 24. A fuel restrictor 26 is preferably fluidly connected to the rail inlet 22. The fuel restrictor 26 includes a reduced diameter port 28 which reduces fuel pressure pulsations within the fuel rail 24. A distal end 30 of the fuel rail 24 is either closed by a cap 32 or, alternatively, by a pressure relief valve (not shown) to return excess pressure fuel to the fuel supply 14.

The fuel rail 24 forms an internal fuel chamber 34 between its inlet end 22 and its distal end 30. This internal fuel chamber 34 is generally circular in cross-sectional shape.

The fuel rail 24 provides fuel to at least two fuel injectors 36 through fuel supply cups 38. Each fuel supply cup 38 is fluidly connected to the fuel rail internal fuel chamber 34 by a fluid port 40 in the fuel rail 24. Consequently, each fuel injector 36 is supplied with fuel through the fuel port 40 in the fuel rail 24 associated with its fuel cup 38.

In order to eliminate or at least reduce the pressure pulsations within the fuel rail 24, a one-way check valve 44 is associated with each fuel injector port 40 except the fuel injector port 40 adjacent the distal end 30 of the fuel rail 24. The check valves 44 are preferably positioned immediately downstream from their associated fuel port 40 and are oriented to only allow fuel flow through the check valve 44 in a direction from the fuel rail inlet 22 and to the distal end 30 of the fuel rail 24.

With reference now to FIGS. 2-5, an embodiment of the check valve 44 is shown. The check valve 44 includes a circular seat 46 having an outside diameter which is substantially the same as the inside diameter of the fuel rail 24. The seat 46 is then secured to the interior of the fuel rail so that the outer periphery of the seat 46 is sealed to the interior bore of the fuel rail 24. Any means, such as welding, brazing, adhesive, or the like, may be used to secure the valve seats 46 within the fuel rail 24. The valve seat 46 also includes a circular port 48 (FIGS. 3-5) formed coaxially through the valve seat 46. Since the outer periphery of the valve seat 46 is sealed within the interior bore of the fuel rail 24, the entire fluid flow of fuel from one fuel injector to downstream fuel injectors must pass through the fuel ports 48.

The check valve 44 is preferably a ball check valve and, as such, includes a ball 50 which controls the flow through the valve port 48. A cage 54 is attached to the valve seat 46 and entraps the ball 50 to the valve seat 46 while still permitting fluid flow through the port 48, around the ball 50, and through the cage 54. Other shape of the check valve is also available. A flat plate formed to the valve seat 46 can be a valve to open or close the port 48. The assembly of this plate type check valve would be easier than ball shape check valve, but this design would require that one end of flat plate be hinged on one side of the valve seat 46 which could result in undesired localized turbulence.

Figure 4:
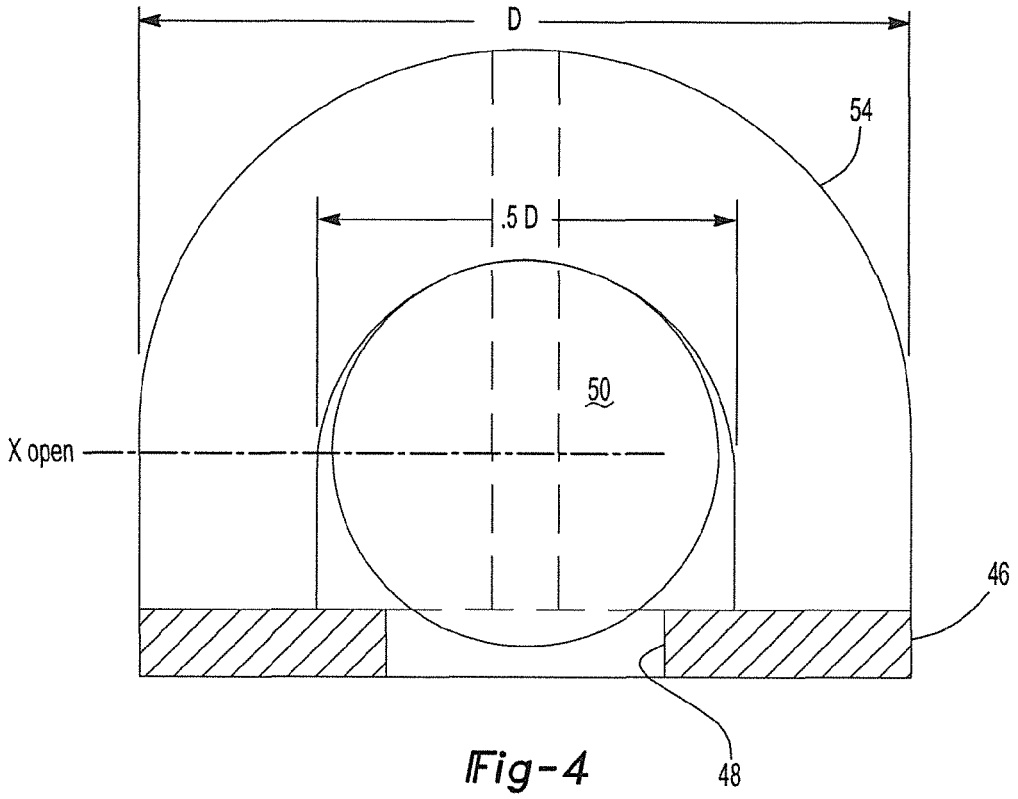
FIG. 4 is a side view of the check valve in an open position.
Figure 5:
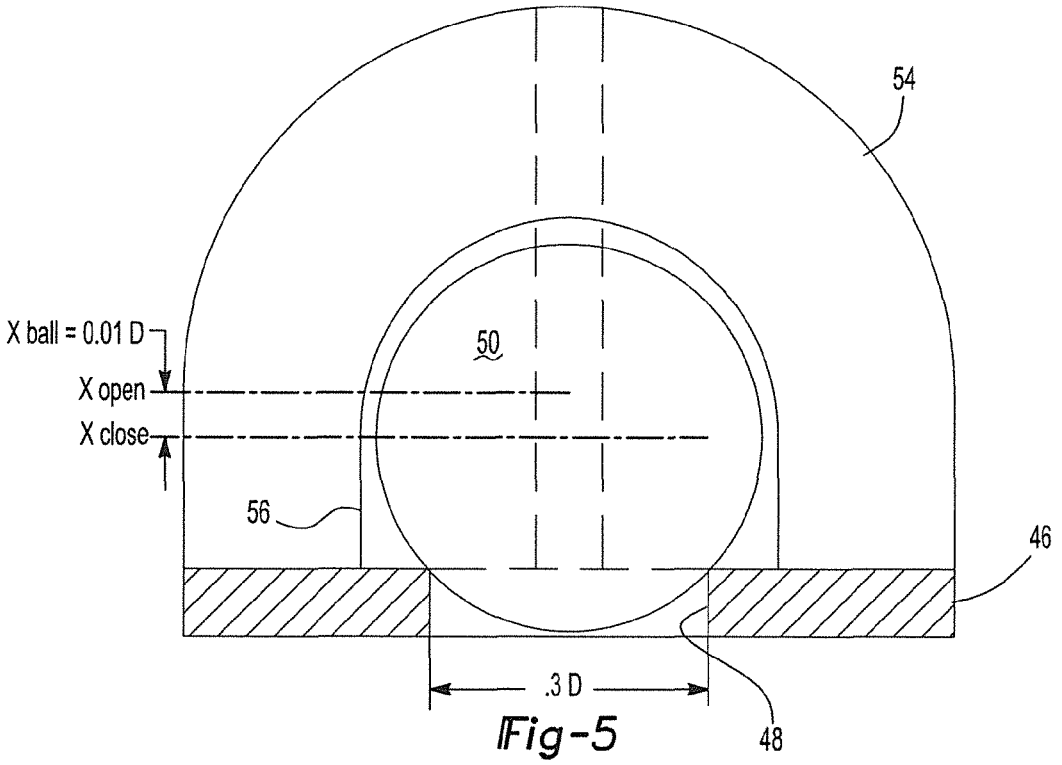
FIG. 5 is a view similar to FIG. 4, but illustrating the check valve in a closed position.

With reference now particularly to FIGS. 4 and 5, the ball 50 is shown in FIG. 5 in its closed position in which the ball 50 abuts against the valve seat 46 around the port 48 thus blocking fluid flow through the port 48. Conversely, movement of the ball to its open position as shown in FIG. 4 in which the ball 50 is spaced from the port 48 allows fluid flow through the port 48 and through the check valve 44. The movement of the ball 50, of course, is controlled by the pressure within the fuel rail internal fuel chamber 34.

Referring now to FIG. 4, assuming that D equals the diameter of the fuel rail internal fuel chamber 34, the outer diameter of the seat 46 has a dimension that is substantially the same, i.e. D. An inner diameter of the cage 54, i.e. an inside surface 56 of the cage 54, preferably has a diameter of approximately 0.5 D whereas the diameter of the ball 50 is preferably 0.4 D (FIG. 5). The diameter of the port 48 is substantially 0.3 D. In addition, the displacement of the ball 50 from the closed position shown in FIG. 5 to the open position shown in FIG. 4 is approximately 0.01 D.

Any material may be used to construct the check valves 44. However, preferably all of the components of the ball valve 44, i.e. the valve seat 46, cage 54, and ball 50, are constructed of a metal or a metal alloy. Other types of materials, however, may alternatively be used.

With reference now to FIG. 1, the check valves 44 should be positioned immediately downstream from their associated fuel ports 44. However, for efficient operation of the fuel system the check valves 44 are preferably positioned one tenth of the space X between adjacent fuel injectors 36 from their associated fuel injector ports 40.

In practice, during the operation of the engine, the fuel pulsations caused not only by the outlet valve from the fuel pump 12, but also by the opening and closure of the fuel injectors 36, creates back and forth fuel flow and fuel pressures within the fuel rail 24. However, during a forward pressure, the check valves 44 open to permit fuel flow through the fuel rail 24 as required. Conversely, upon a reverse pressure pulsation, the check valves 44 close thus greatly reducing not only the vibration otherwise caused by the fuel pressure pulsations, but also noise within the fuel delivery system. Furthermore, since the fuel pressure pulsations are minimized, the instantaneous fuel pressure throughout the entire length of the fuel rail internal fuel chamber 34 is substantially equalized. This, in turn, ensures that substantially an equal fuel pressure is provided to each of the fuel injectors 36.

Figure 6A:
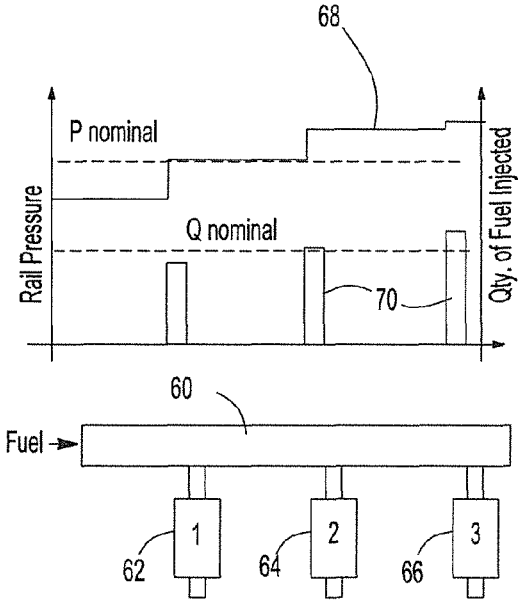
FIGS. 6A and 6B are graphs illustrating fuel rail pressure and volume of fuel injection.

For example, with reference to FIG. 6A, a fuel rail 60 with three spaced fuel injectors 62, 64, and 66 are illustrated diagrammatically. The injector 62 is closest to the inlet of the fuel rail 60 whereas injector 66 is at the distal end of the fuel rail 60. Normal operation of the pump 12 results in the fuel flow from the inlet to the distal end of the rail. The fuel rail 60 does not contain the flow restrictors or one-way valve. Consequently, as shown by graph 68, the fuel rail pressure increases slightly from the inlet to the distal end of the rail. This, in turn, creates an increase in the volume of the injected fuel for the fuel injectors 62-66 as shown by histogram 70.

Figure 6B:
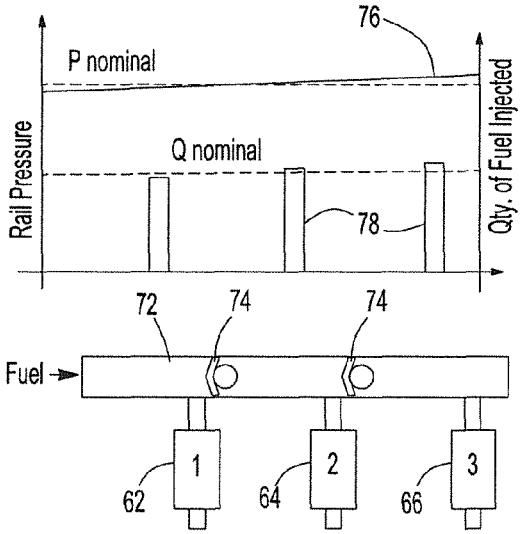

With reference now to FIG. 6B, a fuel rail 72 is illustrated diagrammatically with the same three fuel injectors 62-66. The fuel rail 72 differs, however, from the fuel rail 60 in that a one-way valve or flow restrictor 74 is provided for the fuel injectors 62 and 64. This, in turn, results in a substantially even fuel pressure throughout the entire fuel rail 72 as shown by graph 76. This, in turn, results in a substantially equal volume of fuel injected by each of the fuel injectors 62-66 as shown by histogram 78.

Figure 7:
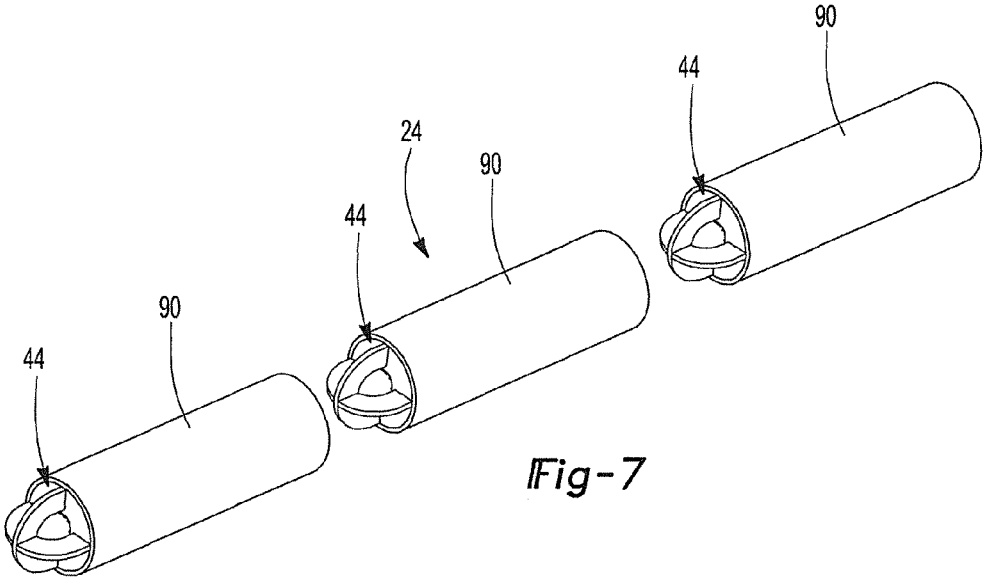
FIG. 7 is an exploded view illustrating the assembly of a fuel rail.

With reference now to FIG. 7, although any method may be utilized to construct the fuel rail with the check valves 44, in one method of fabrication the fuel rail 24 is divided into sections 90 with one section 90 extending between each pair of adjacent fuel injectors. One check valve is then assembled to one end of each section 90 in any conventional fashion, such as welding, brazing, adhesive, and the like.

After the check valves 44 have been installed on their respective fuel rail sections 90, the fuel rail sections 90 are then positioned in axial alignment and in abutment with each other. The fuel rail sections 90 are then sealingly secured together in any conventional fashion, such as by brazing, welding, adhesive, and the like.

From the foregoing, it can be seen that the present invention provides a unique and effective fuel delivery system for fuel injected internal combustion engines, especially of the type used in automotive vehicles. Having described our invention, however, many modifications thereto will become apparent to those skilled in the art to which it pertains without deviation from the spirit of the invention as defined by the scope of the appended claims.

We claim:

1. A fuel delivery system for an internal combustion engine comprising:

a fuel rail defining an internal fuel chamber, at least two fuel injectors fluidly open to the fuel rail internal fuel chamber, at least one fluid check valve fluidly positioned in the internal fuel chamber of the fuel rail between two fuel injectors and dividing said internal fuel chamber into adjacent subchambers, said check valve movable between a closed position in which said check valve fluidly isolates said subchambers from each other and an open position in which said subchambers fluidly communicate with each other.

2. The system as defined in claim 1 wherein one check valve fluidly positioned in the internal fuel chamber of the fuel rail between each two adjacent fuel injectors.

3. The system as defined in claim 2 wherein each check valve is positioned closely adjacent one fuel injector.

4. The system as defined in claim 3 wherein each injector has an associated fuel port in the fuel rail, and wherein one check valve is positioned downstream from the fuel port of its associated fuel injector.

5. The system as defined in claim 4 wherein the spacing between each the check valve and the fuel port of its associated fuel injection is approximately one tenth the spacing between adjacent fuel injectors.

6. The system as defined in claim 1 wherein each check valve comprises a ball check valve.

7. The system as defined in claim 6 wherein each ball check valve comprises a seat having a circular port, a ball and a cage which retains the ball to the cage, the ball movable between a closed position in which the ball abuts against the seat and closes the port, and an open position in which the ball is spaced from the seat and enables fluid flow through the port.

8. The system as defined in claim 7 where the fuel rail internal fuel chamber is circular in cross-sectional shape having a diameter D and wherein the ball has a diameter of approximately 0.4 D.

9. The system as defined in claim 8 wherein an inner diameter of the cage is approximately 0.5 D.

10. The system as defined in claim 8 wherein the diameter of the port is approximately 0.3 D.

11. The system as defined in claim 8 wherein the travel of the ball between an open and a closed position is approximately 0.01 D.

12. The system as defined in claim 8 wherein the cage is made of metal or a metal alloy.

13. The system as defined in claim 8 wherein the ball is made of metal or a metal alloy.

14. The system as defined in claim 1 further comprising:

a fuel pump having a high pressure outlet, wherein the fuel rail defining an internal fuel chamber fluidly connected to the fuel pump outlet.

15. The system as defined in claim 1 wherein said fuel rail comprises a plurality of sections, each section extending between two fuel injectors and having one said check valve attached to said section, said sections being axially aligned and secured together to form said fuel rail.

* * * * *